US006092876A

United States Patent [19]

Arbucci

[11] Patent Number: 6,092,876

[45] Date of Patent: Jul. 25, 2000

[54] APPARATUS FOR FLOOR COVERING REMOVAL

[76] Inventor: Vincent Arbucci, 53 Spence Ave., Holtsville, N.Y. 11742

[21] Appl. No.: 09/240,133

[22] Filed: Jan. 29, 1999

[51] Int. Cl.[7] ..... E21C 47/00

[52] U.S. Cl. ..... 299/37.1; 299/36.1; 15/93.1; 30/170

[58] Field of Search ..... 299/36.1, 37.1, 299/37.2; 15/93.1; 30/169, 170; 29/81.16; 81/45; 404/93; 37/214, 266, 407; 172/737, 778, 799.5, 810, 811, 812, 824, 827

[56] References Cited

U.S. PATENT DOCUMENTS

| | | | |
|---|---|---|---|
| 2,753,638 | 7/1956 | Mork | 172/812 |
| 2,794,273 | 6/1957 | Pilkington et al. | 172/816 |
| 4,963,224 | 10/1990 | Anderson | 299/37.1 X |
| 4,992,020 | 2/1991 | Bartlett | 37/376 |
| 5,058,295 | 10/1991 | Holland | 172/799.5 X |
| 5,098,252 | 3/1992 | Sheesley | 172/273 X |
| 5,197,784 | 3/1993 | Holder | 299/37.1 |
| 5,641,206 | 6/1997 | Craft | 299/37.1 |
| 5,702,161 | 12/1997 | Finney et al. | 299/37.1 |
| 5,720,844 | 2/1998 | Hanson | 299/37.1 X |
| 5,772,284 | 6/1998 | Lindsey et al. | 299/36.1 |
| 5,830,313 | 11/1998 | Smith | 299/37.1 X |

*Primary Examiner*—Eileen Dunn Lillis
*Assistant Examiner*—Sunil Singh
*Attorney, Agent, or Firm*—Michael I Kroll

[57] ABSTRACT

An apparatus which will be attached to a motorized vehicle such as a frontend loader having auxiliary hydraulic structure wherein the apparatus having a hydraulic motor 18 will be connected by flexible lines 58 to the auxiliary hydraulic structure. The floor covering removal apparatus will be mounted on the frontend of the frontend loader whereby an individual can angularly lower the floor covering removal apparatus blade 52 until the blade of the apparatus being forwardly mounted is in a position to scrape the floor removing carpet, tiles, and wood flooring as the motorized vehicle is operated. Optionally the hydraulic motor 18 of the floor covering removal apparatus can use the auxiliary hydraulic structure for advancing and retracting the blade 52 in rapid succession thereby providing a chopping action to the blade 52 of the floor covering removal apparatus while the apparatus performs the floor covering removal tasks. An alternate embodiment provides an enclosure 72 to the hydraulic motor.

15 Claims, 9 Drawing Sheets

APPARATUS FOR FLOOR COVERING REMOVAL

BACKGROUND OF THE INVENTION

1. Field of the Invention

The present invention relates generally to floor covering removal and, more specifically, to an apparatus which attaches to a motorized vehicle, and wherein said motorized vehicle can have auxiliary hydraulic means wherein said apparatus may be connected by flexible lines to said auxiliary hydraulic means, and wherein said floor covering removal apparatus will be mounted onto said motorized vehicle thereby an individual can position said apparatus until the blade of said floor covering removal apparatus being forwardly mounted is in a position to scrape the floor removing carpet, tiles, and wood flooring and in addition where said motorized vehicle having auxiliary hydraulic means and said floor covering removal apparatus having motorized means for advancing and retracting said blade in rapid succession providing a chopping action to said blade while removing said floor coverings such as, carpeting, tiles, wood, flooring, ceramic, and stone.

2. Description of the Prior Art

There are numerous methods presently employed in the removal of floor coverings, most of which involve a great deal of time and manual labor or dedicated expensive floor covering removal machinery which can only be used for floor covering removal. The present invention provides an attachment to a motorized vehicle which has the capability of eliminating the labor intensive and expensive manual method, the necessity for expensive dedicated machinery, as well as reducing the amount of time needed to perform the floor covering removal task and can expand the functionality of a piece of equipment such as a small front loader.

There are other devices designed to remove floor coverings. Typical of these is U.S. Pat. No. 5,772,284 issued to Lindsay et al. on Jun. 30, 1998.

Another patent was issued to Hanson on Feb. 24, 1998 as U.S. Pat. No. 5,720,844. Yet another U.S. Pat. No. 5,641,206 was issued to Craft on Jun. 24, 1997 and still yet another was issued on Mar. 30, 1993 to Holder as U.S. Pat. No. 5,197, 784.

U.S. Pat. No. 5.772,284

Inventor: Stephrn B. Lindsey, et al.

Issued: Jun. 30, 1998

A multipurpose surface stripper apparatus is provided for removing surface coverings, linoleum, tile, or carpet from a supporting surface, floor or deck. The apparatus includes a chassis having a frame, a stripping assembly, a drive assembly, and a hydraulic system for controlling the operation of the stripping and drive assemblies. The stripping assembly includes a stripping blade, a blade mount, at least one carrier bearing fixably mounted to a supporting plate, and a roll axle extending through the carrier bearing for changing the roll of the blade. The axle has one end fixably connected to a lower surface of the blade mount and a second end connected to the stationary end of a pitch control hydraulic cylinder. The carrier bearing supporting plate is mounted between the blade mount and the front end of the frame. The carrier bearing changes the roll and pitch of the blade with respect to the supporting surface to allow the edge of the blade with respect to the supporting surface to allow the edge of the blade to adjust to the surface contours, adhesive deposits, and similar surface imperfections.

U.S. Pat. No. 5,720,844

Inventor: Keith Hanson

Issued: Feb. 24, 1998

A floor covering removal apparatus and method are provided. The apparatus includes a frame for supporting the apparatus and a pair of interlocking gears which selectively and controllably feed a desired width of floor covering through the apparatus. One of the gears is driven by a drive which causes the apparatus to displace over a floor surface as the floor covering is fed through the apparatus. Cutting blades are mounted to the frame which cut the floor covering prior to engaging the interlocking gears. A locking handle is provided to positively lock the floor covering between the interlocking gears prior to displacement of the apparatus along the floor surface, A control assembly enables an operator to selectively control the direction in which the apparatus is displaced.

U.S. Pat. No. 5,641,206

Inventor: David B. Craft

Issued: Jun. 24, 1997

An apparatus for removing at least one surface layer from a floor or the like comprises a machine body having a longitudinal axis, rear weight-bearing guide wheels, and a front bearing wheel. A front weight-bearing scraping apparatus is pivotable with respect to the machine body by a cylinder located between the machine body and the front weight-bearing scraping apparatus. The machine body is thus configurable between a first machine transport position in which the front weight-bearing wheel contacts the surface being scraped and the front weight-bearing scraping apparatus is elevated from the surface being scraped and the longitudinal axis of the machine body is substantially parallel with the horizontal plane of the surface being scraped; and a second surface-scraping position in which the front weight-bearing wheel is elevated from the surface being scraped and the front weight-bearing scraping apparatus contacts the surface being scraped and the longitudinal axis of the machine body is parallel to the horizontal plane of the surface being scraped.

U.S. Pat. No. 5,197,784

Inventor: Tommie Holder

Issued: Mar. 30, 1993

An apparatus for removing floor covering which has a frame supported by wheels. Some of the wheels are used to drive the frame and these wheels are powered by a structurally independent power source. A tool secured to the frame, may be used to push up floor covering.

While these floor covering removal devices may be suitable for the purposes for which they were designed, they would not be as suitable for the purposes of the present invention, as hereinafter described.

SUMMARY OF THE PRESENT INVENTION

The present invention is an apparatus which will be attached to a motorized vehicle such as a frontend loader having auxiliary hydraulic means wherein the apparatus having a hydraulic motor will be connected by flexible lines to the auxiliary hydraulic means. The floor covering removal apparatus will be mounted on the frontend of said front loader whereby an individual can angularly lower the floor covering removal apparatus blade until the blade of the apparatus being forwardly mounted is in a position to scrape the floor removing carpet, tiles, and wood flooring as the motorized vehicle is operated. Optionally the hydraulic motor of the floor covering removal apparatus can use the auxiliary hydraulic means for advancing and retracting the blade in rapid succession thereby providing a chopping action to the blade of the floor covering removal apparatus while the apparatus performs the floor covering removal tasks. An alternate embodiment provides an enclosure to the hydraulic motor.

A primary object of the present invention is to provide an apparatus which can be attached to a front loader for the purposes of floor covering removal.

Another object of the present invention is to provide an apparatus with a blade assembly which can be angularly adjusted to facilitate floor covering removal.

Another object of the present invention is to provide an apparatus having torsion control assemblies extending from the main housing platform to the blade assembly.

A still further object of the present invention is to provide a motor having off-center rotational means connected by a drive shaft to said blade assembly for the purposes of providing a chopping action to said blade assembly.

A yet further object of the present invention is to provide control means for selectively engaging or disengaging said chopping action of said blade assembly.

Another object of the present invention is to provide a rapid mechanical and economical means for removing floor coverings.

Additional objects of the present invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

In order that the invention may be more fully understood, it will now be described, by way of example, with reference to the accompanying drawings in which.

LIST OF REFERENCE NUMERALS

Figure 1:
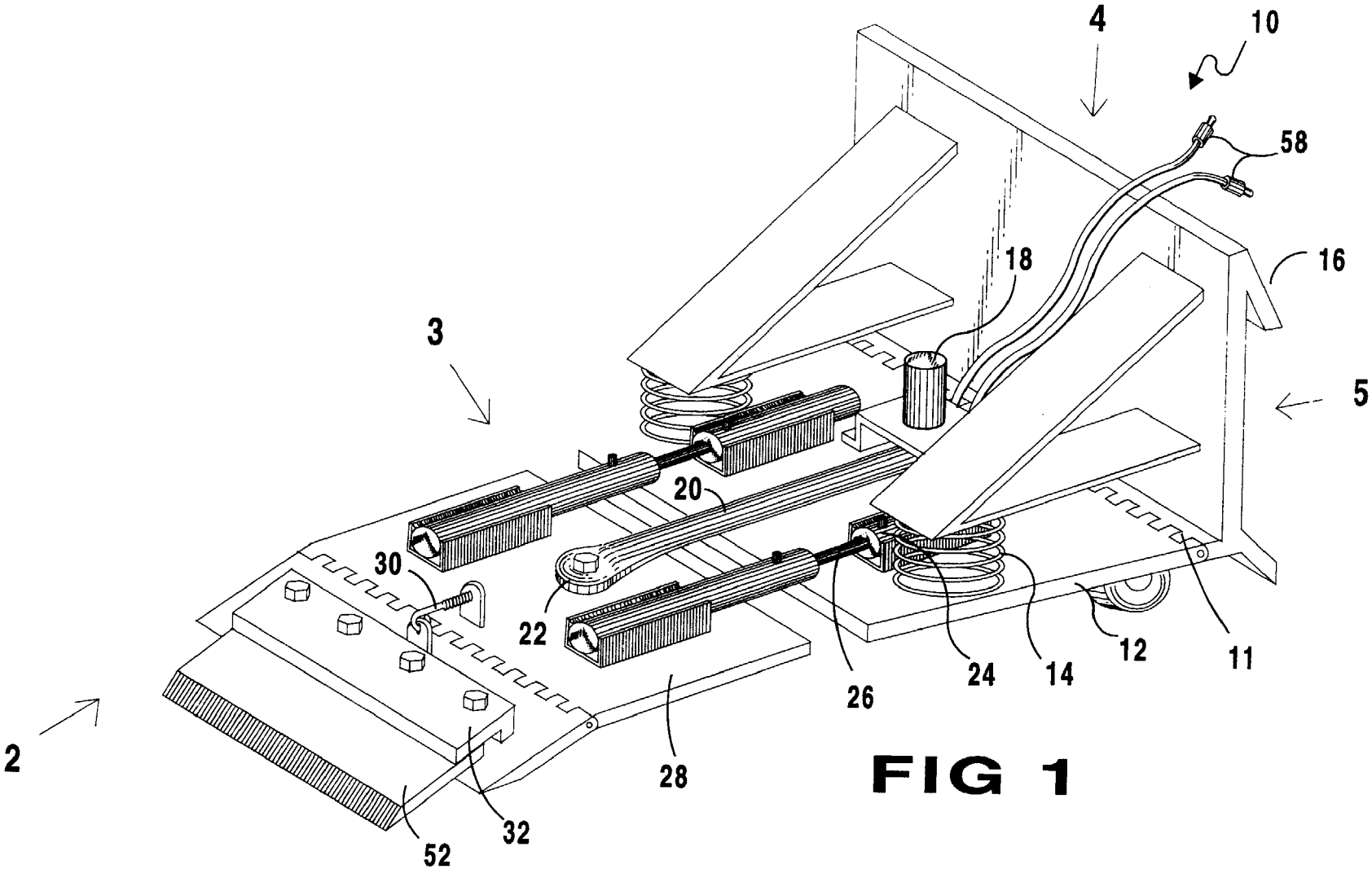
FIG. 1 is a perspective view of the present invention. Shown is a steel plated hinged housing having wheels and a set of springs for maintaining said housing parallel to the surface being scraped and said apparatus having means for attachment 16 to a motorized vehicle and whereupon said housing is mounted to a hydraulic motor having an off-center shaft connected to a blade assembly drive shaft at one distal end and connected to the blade assembly at the other distal end 22. Also mounted on said steel plated housing and situated on each side of said blade assembly drive shaft are blade torsion control assemblies which are connected to the blade assembly by slidable members. Also shown is the blade assembly having angular adjustment means and holding means for inserting a removable blade.

With regard to the reference numerals used, the following numbering is used throughout the drawings.

10 present invention
11 hinge
12 housing
14 springs
16 attachment means
18 motor
20 drive shaft
22 connection means
24 torsion control assembly
26 slidable member
28 blade assembly
30 angular adjustment means
32 blade holder
34 off-center shaft
36 channel
38 casing members
39 weld
40 grease fittings
42 wheels
44 steel platform
45 hinge
46 blade holder
48 base member
52 blade
56 bolt means
58 hydraulic connection means
62 aperture
64 attachment means
66 aperture
68 fastener
70 nut
72 access panel
74 hinge
76 handle

DESCRIPTION OF THE PREFERRED EMBODIMENT(S)

Turning now descriptively to the drawings, in which similar reference characters denote similar elements throughout the several views, FIGS. 1 through 9 illustrate the present invention being a device for removing floor coverings.

Turning to FIG. 1, therein is shown a perspective view of the present invention 10. Shown is a steel plated hinged housing 12 with hinge 11 and a paired set of springs 14 for maintaining the housing parallel to the surface being scraped. The hinge 11 allows the blade 52 to be on an inclined surface or a differently angled surface than the rear of the housing attached to a motorized vehicle (not shown) and still be in contact with the surface. The apparatus 10 has means for attachment 16 to a motorized vehicle (not shown) and thereupon said housing 12 is mounted a hydraulic motor 18 with hydraulic connection means 58 having an off-center shaft connected to a blade assembly drive shaft 20. The motor 18 is connected to one distal end of the shaft 20 and the other distal end 22 of the shaft is connected to the blade assembly. Also mounted on the steel plated housing 12 and situated on each side of the blade assembly drive shaft 20 are blade torsion control assemblies 24 which are connected to the blade assembly 28 by slidable members 26. Also shown is the blade assembly 28 having angular adjustment means 30 and holding means 32 for inserting a removable blade 52. The blade torsion control assembly 24 is necessary to maintain the blade 52 perpendicular to the direction of travel if the blade strikes a difficult to move object on one end which tends to turn the blade direction.

Figure 2:
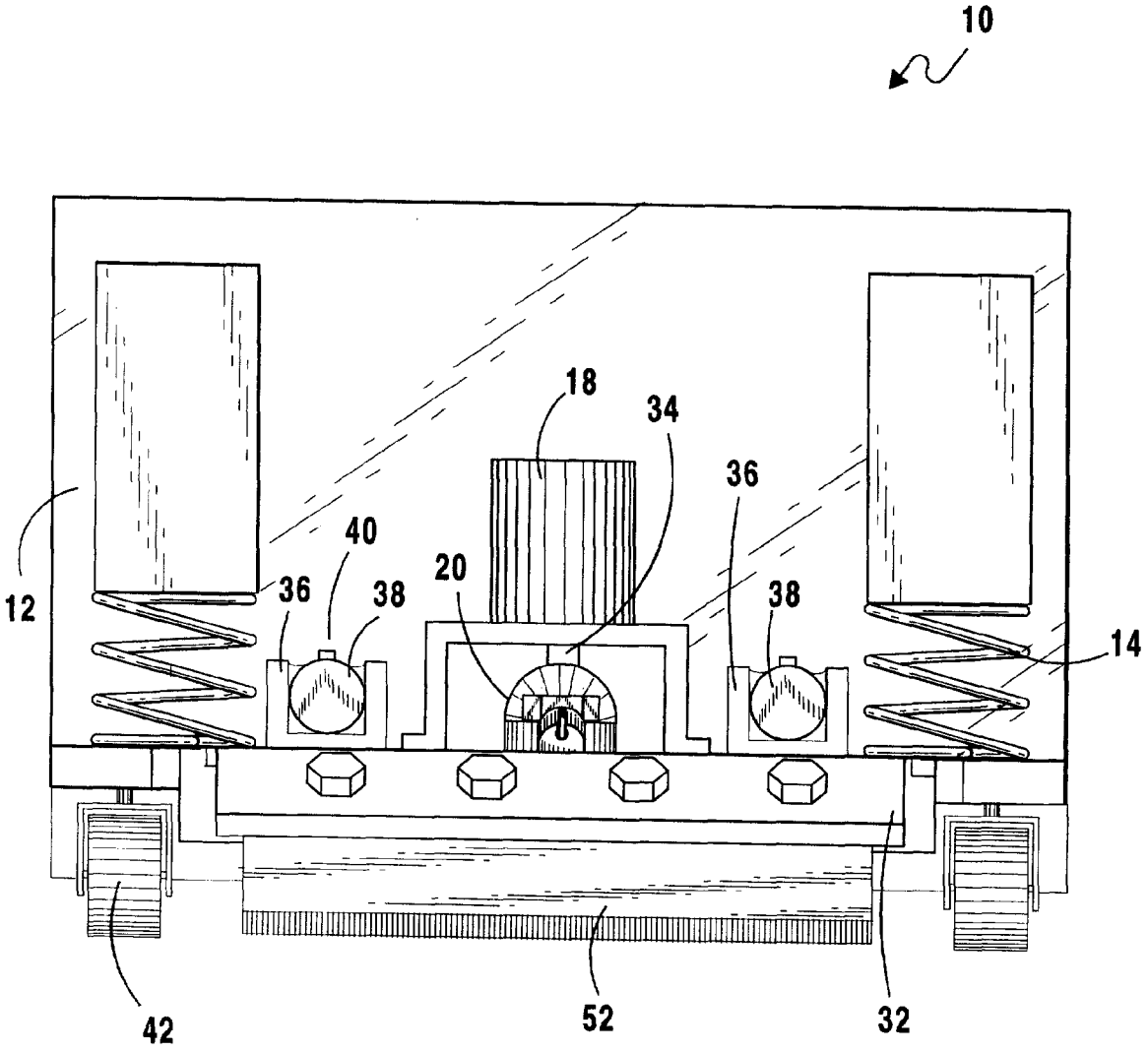
FIG. 2 is a front elevation view of the present invention, taken from FIG. 1 as indicated, showing the blade within the blade holding bracket. Also shown is the off-center shaft of the hydraulic motor which is connected to the blade assembly drive shaft. Also shown are U-shaped channel members wherein are welded the stationary casing members of the blade torsion control assemblies and wherein said casing members having a number of grease fittings for applying an amount of lubricant into the bore of said casings to reduce the friction between the casing bore and the slidable members of the blade torsion control assembly. Also shown are the wheels and springs used to maintain the housing parallel to the surface being scraped.

Turning to FIG. 2, therein is shown a front elevation view of the present invention 10, taken from FIG. 1 as indicated, showing the blade 52 within the blade holding bracket 32. Also shown is the off-center shaft 34 of the hydraulic motor 18 which is connected to the blade assembly drive shaft 20. Also shown are U-shaped channel members 36 wherein are welded the stationary casing members 38 having a number of grease fittings 40 for applying an amount of lubricant into the bore of said casings 38 to reduce the friction between the casing bore and the slidable members of the blade torsion control assembly 24 (not shown). Also shown are the wheels 42 and springs 14 used to maintain the housing 12 parallel to the surface being scraped.

Figure 3:
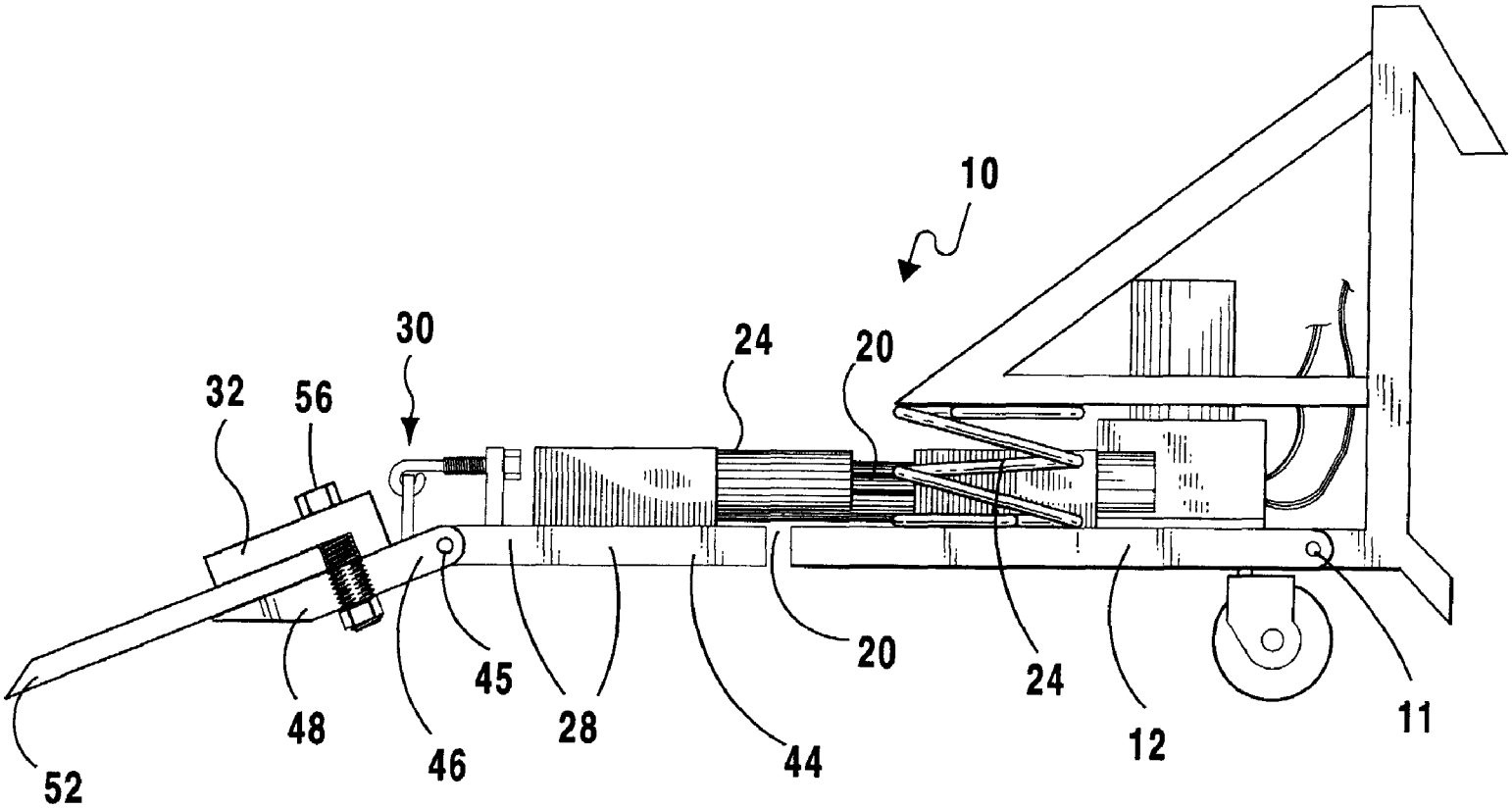
FIG. 3 is a side view of the present invention, taken from FIG. 1 as indicated, showing the blade assembly connected to the steel hinged housing by the blade assembly drive shaft and the blade torsion control assembly. The blade assembly consists of a steel platform, whereupon is mounted one end of the blade torsion control assembly and the blade assembly drive shaft, and a hinged blade holder having a blade holder base member being hinged to the blade assembly platform and having angular adjustment means thereto. The blade is forwardly mounted and extending beyond said blade holder base member and held by clamping means between said blade holder base member and a blade mounting bracket which is bolted to the blade holder base member.

Turning to FIG. 3, therein is shown a side view of the present invention 10 taken from FIG. 1 as indicated, showing the blade assembly 28 connected to the steel hinged housing 12 by the blade assembly drive shaft 20 and the blade torsion control assembly 24. The blade assembly 28 consists of a steel platform 44 whereupon is mounted one end of the blade torsion control assembly 24 and the blade assembly drive shaft 20 in a hinged blade holder 46 with hinge 45 having a blade holder base member 48 being hinged 45 to the blade assembly platform 44 and having angular adjustment means 30 attached thereto. The blade 52 is forwardly mounted and extends beyond said blade holder base member 48 and held by clamping means 32 between said blade holder base member 48 and a blade mounting bracket 32 which is bolted by means 56 to the blade holder base member 48.

Figure 4:
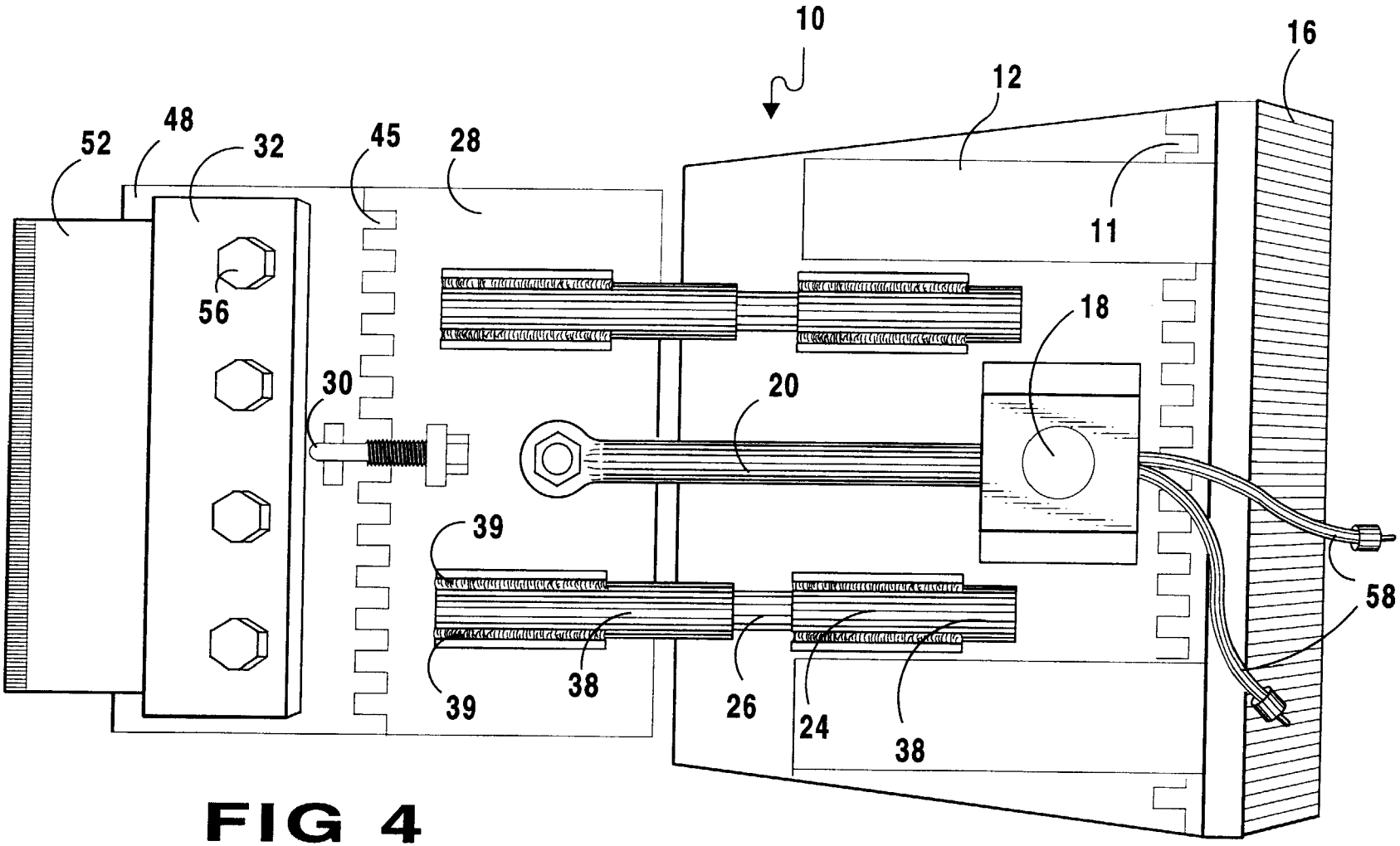
FIG. 4 is a top plan view of the present invention, taken from FIG. 1 as indicated. Shown is the hinged steel housing whereupon is mounted a hydraulic motor having connection means to the hydraulic system of the motorized vehicle and a blade assembly drive shaft providing connection means to the blade assembly. Also mounted to the blade assembly and the steel housing are stationary members of the blade torsion assembly connected by a blade torsion assembly shaft.

Turning to FIG. 4, therein is shown a top plan view of the present invention 10 taken from FIG. 1, as indicated. Shown is the hinged steel housing 12 with hinge 11 whereupon is mounted a hydraulic motor 18 having connection means 58 to the hydraulic system of the motorized vehicle (not shown) and a blade assembly drive shaft 20 providing connection means to the blade assembly 28. Also mounted to the blade assembly 28 and the steel housing 12 are stationary members 38 with welds 39 of the blade torsion assembly 24 connected by a slidable blade torsion assembly shaft 26. Also shown are blade 52, and blade holder base member 48.

Figure 5:
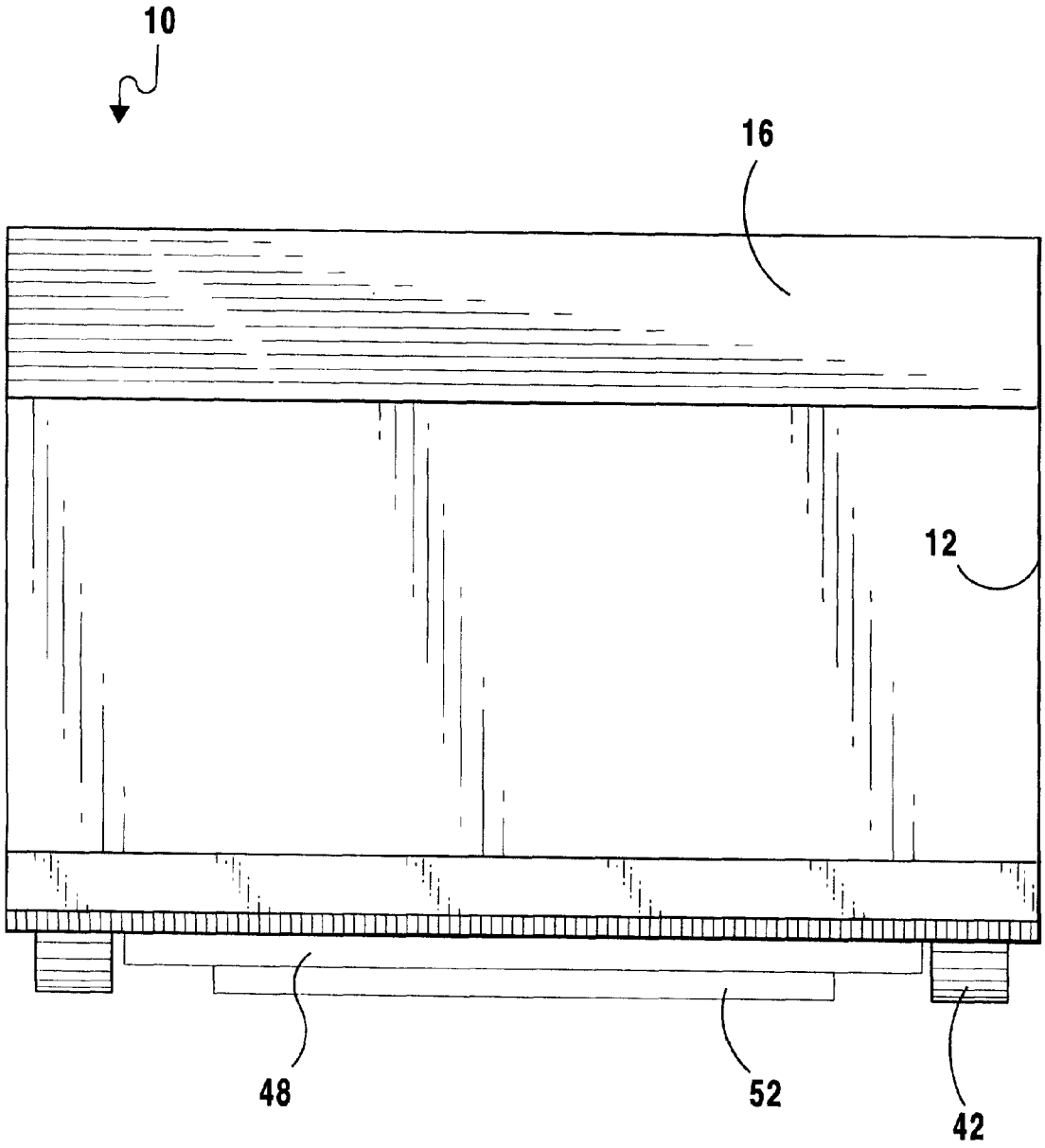
FIG. 5 is a rear elevation view of the present invention, taken from FIG. 1 as indicated, showing the lip of the steel housing providing means for attachment to a motorized vehicle.

Turning to FIG. 5, therein is shown rear elevation view of the present invention 10, taken from FIG. 1 as indicated, showing the lip 16 of the steel housing 12 providing means for attachment to a motorized vehicle (not shown). Also shown are the wheels 42, blade 52, and base member 48.

Figure 6:
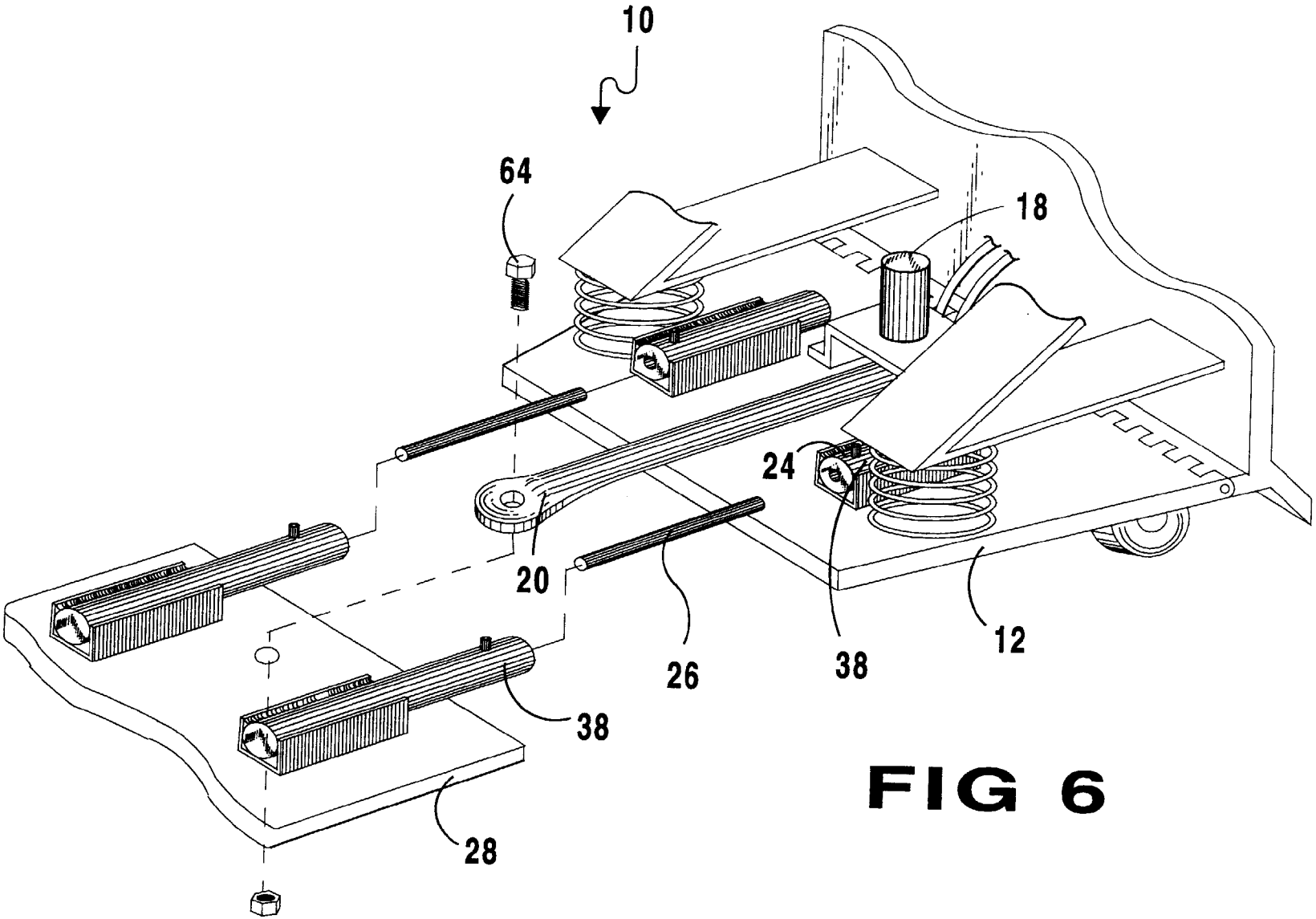
FIG. 6 is an exploded view of the connection components of the preferred embodiment of the present invention. Shown is a partial view of the hinged steel housing and a partial view of the blade assembly. Each having attached thereupon one end member of a pair of torsion control assemblies. Each member is connected to its counterpart member by a central shaft. Also shown is the hydraulic motor drive shaft which when connected to the hydraulic motor and the blade assembly causes the two assemblies to form an integral floor covering removal apparatus having blade torsion control.

Turning to FIG. 6, therein is shown an exploded view of the connection components of the preferred embodiment of the present invention 10. Shown is a partial view of the hinged steel housing 12 and a partial view of the blade assembly 28, each having attached thereupon one end member 38 of a pair of torsion control assemblies 24 with each member connected to its counterpart member by a slidable central shaft 26. Also shown is the drive shaft 20 which when connected to the hydraulic motor 18 and the blade assembly 28 causes the two assemblies to form an integral floor covering removal apparatus 10 having blades torsion control 24 for maintaining the blade perpendicular to the direction of movement to maintain efficiency of cutting.

Figure 7:
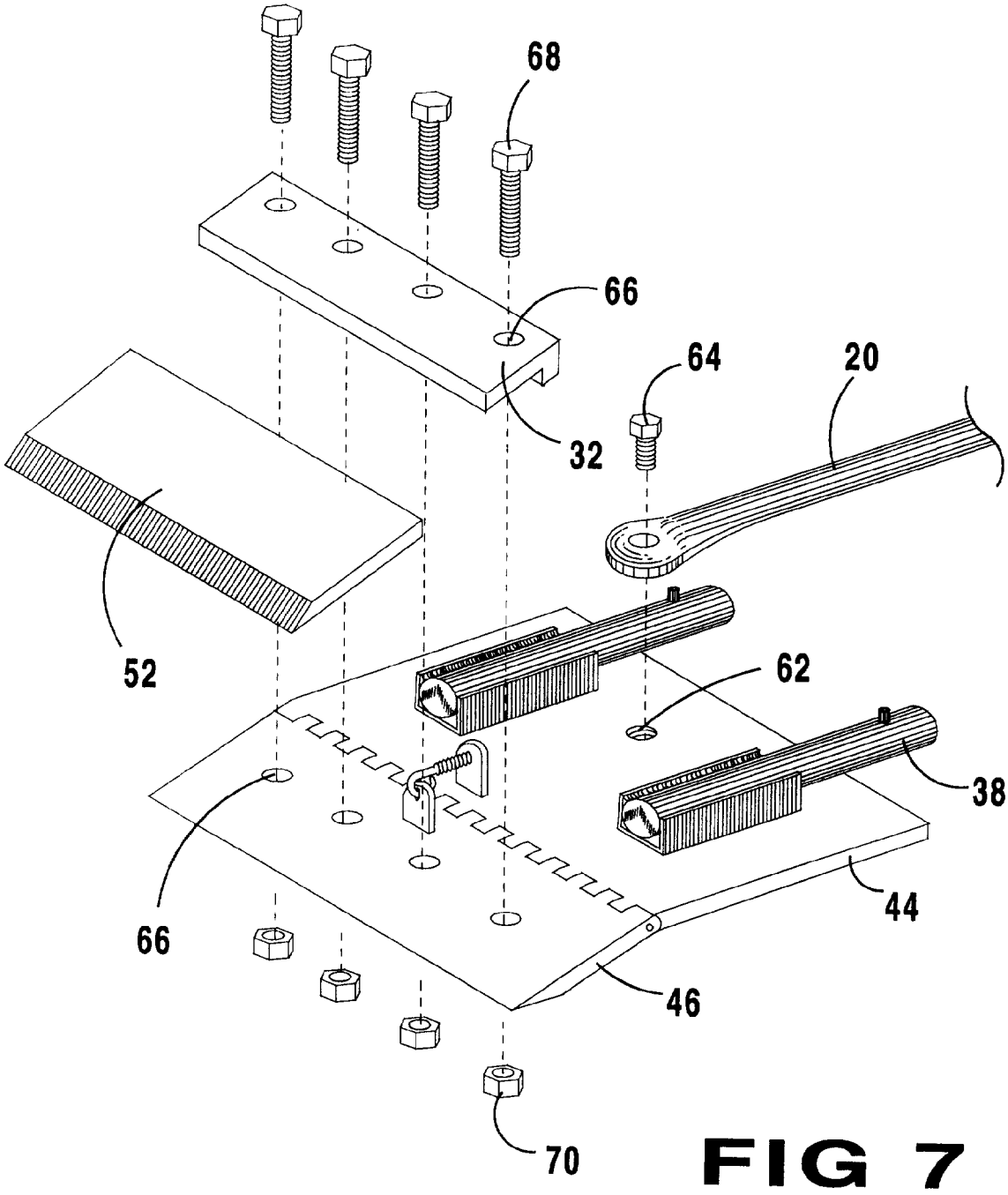
FIG. 7 is an exploded view of the present invention. Shown is an angular blade assembly platform having fixedly mounted members of the torsion control assemblies and an aperture for removably attaching the blade assembly drive shaft. Also shown is a blade holding bracket having a plurality of apertures for removably inserting a number of fasteners which will fasten through a matching number of apertures located on the angled portion of the blade assembly platform by means of a number of nuts, Thereby, upon insertion of the blade between the blade bracket and the blade assembly platform and the torquing of the fasteners the blade will be adjustable clamped and furthermore, the lip located on the blade holder bracket will substantially conform to the thickness of the blade thereby providing more surface contact between the blade and blade holder and additionally the blade holder can be stepped allowing the blade holder to act as a stop for the blade as the blade is adjustably advanced due to wear thereby increasing the life of the blade.

Turning to FIG. 7, therein is shown an exploded view of selected components of the present invention. Shown is an angular blade assembly platform 44 having fixedly mounted members of the torsion control assemblies 38 and threaded aperture 62 for removably attaching with attachment means 64 the blade assembly drive shaft 20. Also shown is a blade holding bracket 32 having a plurality of apertures 66 for removably inserting a plurality of fasteners 68, e.g., nuts and bolts or the like, which will fasten through a matching number of apertures 66 located on the angular portion of the blade assembly platform 46 by means of a number of nuts 70. Thereby, upon insertion of the blade 52 between the blade bracket 32 and the blade assembly platform 46 and the tightening of the fasteners 68, 70, the blade 52 will be adjustably clamped and, furthermore, the rear lip located on the blade holder bracket 32 will substantially conform to the thickness of the blade 52 thereby providing more surface contact between the blade 52 and blade holder 32 and additionally the blade can be directionally forwardly stepped with serrations (not shown) on the face of bracket 32 allowing the blade holder to act as a stop or rest for the blade 52 as the blade is adjustably forwardly advanced due to wear shortening blade 52 thereby increasing the life of the blade 52.

Figure 8:
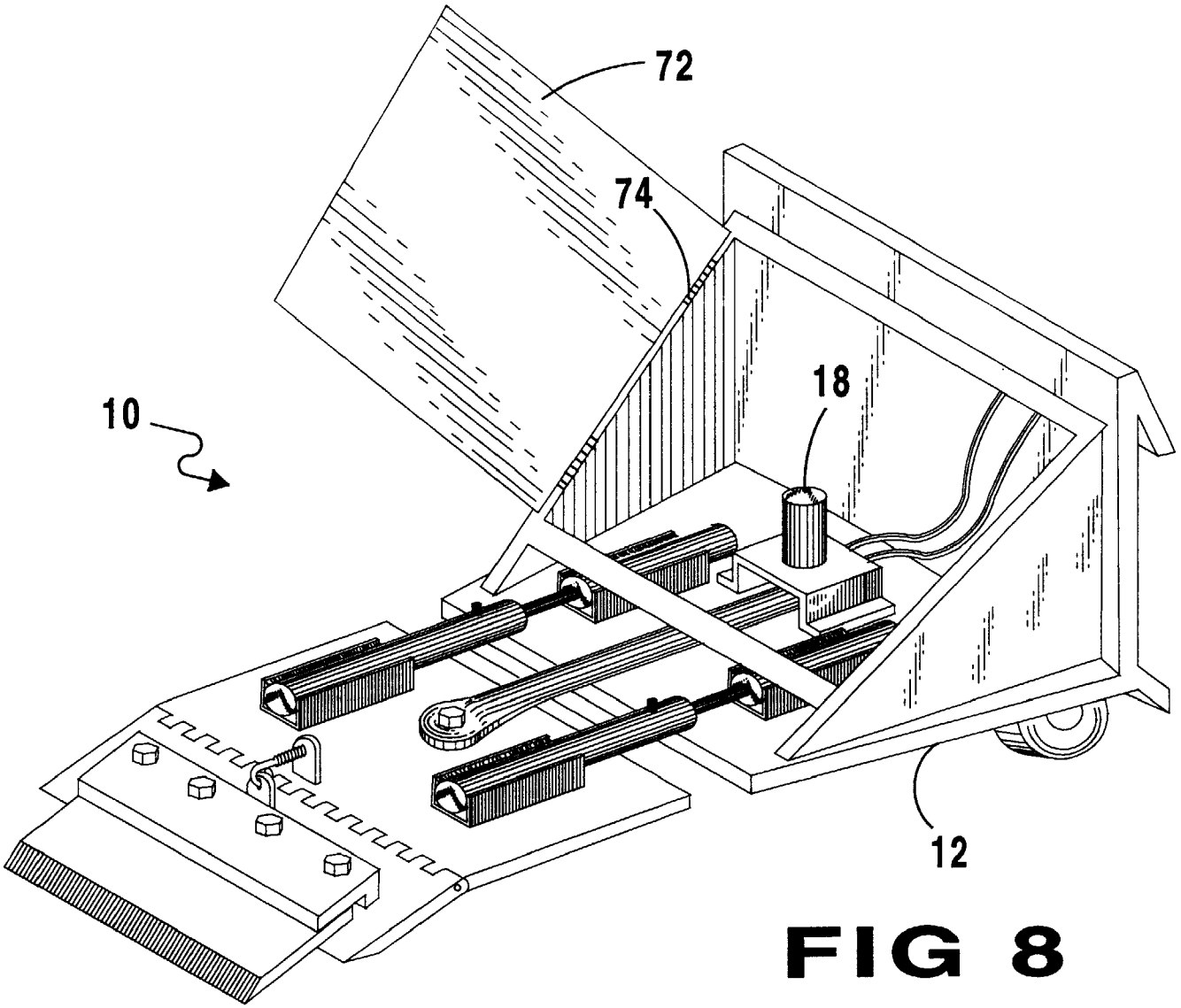
FIG. 8 is a perspective view of an alternate embodiment of the present invention having the steel housing substantially closed with an access panel, shown in the open position allowing access, thereby protecting the hydraulic motor from contamination by the shards and dust of the floor covering material.

Turning to FIG. 8, therein is shown a perspective view of an alternate embodiment of the present invention 10 having the steel housing 12 substantially enclosed with a hinged access panel 72 and hinge 74, shown in the open position allowing access, thereby protecting the hydraulic motor 18 from contamination by the shards and dust of the floor covering material.

Figure 9:
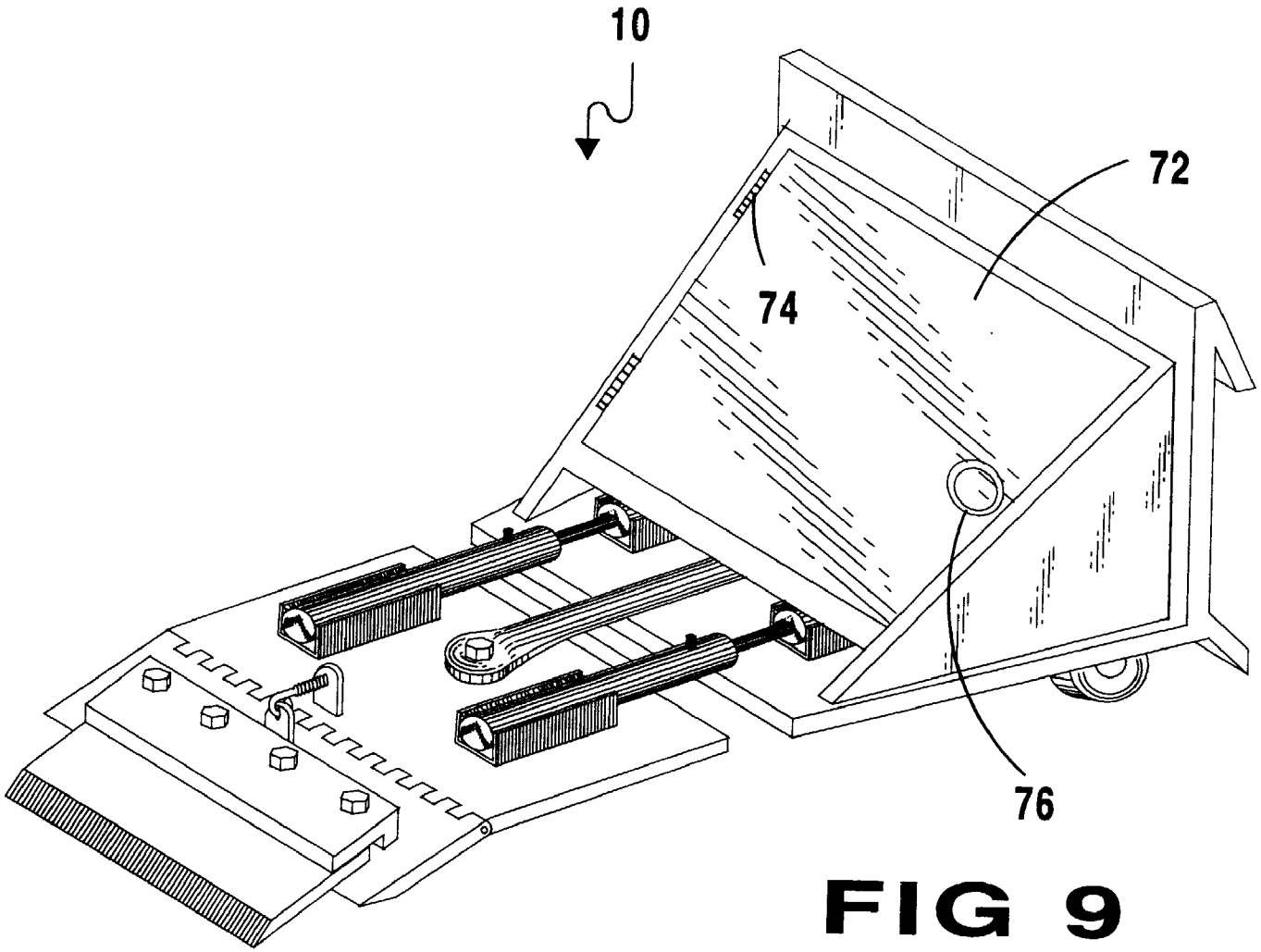
FIG. 9 is a perspective view of the alternate embodiment of the present invention shown in FIG. 8 with the access door panel in the closed position thereby protecting the hydraulic motor from damage and contamination by pieces of the removed floor covering.

Turning to FIG. 9, therein is shown a perspective view of the alternate embodiment of the present invention 10 shown in FIG. 8 with the access door panel 72 and hinge 74 and handle 76 in the closed position thereby protecting the hydraulic motor from damage and contamination by pieces of removed floor covering.

What is claimed to be new and desired to be protected by Letters Patent is set forth in the claims:

1. An apparatus for removing floor coverings, comprising:

a) a first steel platform for housing components;

b) a pair of springs for leveling the platform;

c) a pair of wheels attached to said platform for travelling about;

d) a drive shaft;

e) a motor mounted on said first steel platform for providing a reciprocating motion to said drive shaft;

f) a second steel platform for holding selected components having means for connection to said drive shaft;

g) means for maintaining said second steel platform perpendicular to the direction of travel of said first steel platform;

h) a blade for removing the floor coverings; and, i) means for mounting said blade onto said second steel platform.

2. The apparatus of claim 1, said first steel platform having means for attachment to a motorized vehicle.

3. The apparatus of claim 2, said means for attachment further comprising a lip on said first steel platform for attachment to a motorized vehicle.

4. The apparatus of claim 1, said motor further comprising off-center rotational means for reciprocating said drive shaft.

5. The apparatus of claim 1, said means for maintaining the movement of said second steel platform perpendicular to the direction of travel further comprising a pair of elongated members fixedly attached at each end to said first and second steel platform.

6. The apparatus of claim 5, said elongated members further comprising slidable members connecting each end of said elongated members.

7. The apparatus of claim 5, further comprising said pair of elongated members fixedly mounted in U-shaped channel members said fixedly mounting further comprising welding.

8. The apparatus of claim 1, said blade being angularly adjustable with the floor.

9. The apparatus of claim 1, said means for mounting said blade onto said second steel platform further comprises a base plate said base plate being hingeably connected to said second steel platform.

10. The apparatus of claim 9, said means for mounting said blade onto said second steel platform further comprises a bracket for fixedly holding said blade onto said hingedly mounted base plate.

11. The apparatus of claim 10, said bracket further comprises means for connection to said base plate.

12. The apparatus of claim 11, said bracket and said base plate having a plurality of apertures therein, said means for connection to said base plate further comprising a plurality of nuts and bolts passing through said apertures in said bracket and said base plate.

13. The apparatus of claim 1, said drive shaft having means for connection to said second steel platform.

14. The apparatus of claim 13, said means for connection further comprising a nut and bolt.

15. The apparatus of claim 1, wherein said motor is hydraulically operated further comprising means for hydraulic connection to a motorized vehicle.

* * * * *